US012709833B2

(12) United States Patent
Xu et al.

(10) Patent No.: US 12,709,833 B2
(45) Date of Patent: Aug. 18, 2026

(54) WASHING MACHINE AND CONTROL METHOD THEREFOR

(71) Applicants: QINGDAO HAIER WASHING MACHINE CO., LTD., Qingdao (CN); HAIER SMART HOME CO., LTD., Qingdao (CN)

(72) Inventors: Sheng Xu, Qingdao (CN); Yanfen Lv, Qingdao (CN)

(73) Assignees: QINGDAO HAIER WASHING MACHINE CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 207 days.

(21) Appl. No.: 18/703,143

(22) PCT Filed: Sep. 30, 2022

(86) PCT No.: PCT/CN2022/123101
§ 371 (c)(1),
(2) Date: Apr. 19, 2024

(87) PCT Pub. No.: WO2023/066014
PCT Pub. Date: Apr. 27, 2023

(65) Prior Publication Data

US 2025/0223748 A1 Jul. 10, 2025

(30) Foreign Application Priority Data

Oct. 21, 2021 (CN) ..... 202111226354.4

(51) Int. Cl.
*D06F 39/10* (2006.01)
*D06F 23/02* (2006.01)
(Continued)

(52) U.S. Cl.
CPC ..... *D06F 39/10* (2013.01); *D06F 23/02* (2013.01); *D06F 39/083* (2013.01); *D06F 33/43* (2020.02);
(Continued)

(58) Field of Classification Search
CPC ..... D06F 39/10; D06F 39/083; D06F 33/43; D06F 2103/42; D06F 2105/34; D06F 23/02
See application file for complete search history.

(56) References Cited

U.S. PATENT DOCUMENTS

2020/0270795 A1* 8/2020 Zarcone ..... D06F 34/22

FOREIGN PATENT DOCUMENTS

CN 202247414 U 5/2012
CN 204000331 U 12/2014
(Continued)

OTHER PUBLICATIONS

Machine translation of WO 2017/043290 A1 to Iwasaki. (Year: 2017).*

(Continued)

*Primary Examiner* — Joseph L. Perrin
(74) *Attorney, Agent, or Firm* — Buchanan Ingersoll & Rooney PC

(57) ABSTRACT

A washing machine includes: a water holding barrel; a circulation filtration pipeline, of which a water inlet end and a water outlet end of the circulation filtration pipeline are respectively connected with the water holding barrel; a filter device, arranged in the circulation filtration pipeline, and having a water inlet, a filtered water outlet and a sewage outlet; a sewage pipeline, being used for receiving sewage discharged from the sewage outlet; a control valve assembly, arranged between the water inlet end of the circulation filtration pipeline and the filter device. The control valve
(Continued)

assembly includes a first valve chamber and a second valve chamber that are independent from each other, and the first valve chamber communicates with the water holding barrel and the water inlet of the filter device, and the second valve chamber communicates with the sewage pipeline and the sewage outlet of the filter device.

13 Claims, 4 Drawing Sheets

(51) Int. Cl.

| | |
|---|---|
| ***D06F 39/08*** | (2006.01) |
| *D06F 33/43* | (2020.01) |
| *D06F 103/42* | (2020.01) |
| *D06F 105/34* | (2020.01) |

(52) U.S. Cl.
CPC ..... *D06F 2103/42* (2020.02); *D06F 2105/34* (2020.02)

(56) References Cited

FOREIGN PATENT DOCUMENTS

| | | | | |
|---|---|---|---|---|
| CN | 104862926 | A | 8/2015 | |
| CN | 104911860 | A | 9/2015 | |
| CN | 105648711 | A | 6/2016 | |
| CN | 105420989 | B | 4/2023 | |
| WO | 2014089651 | A1 | 6/2014 | |
| WO | WO-2017043290 | A1 * | 3/2017 | ..... D06F 39/10 |

OTHER PUBLICATIONS

International Search Report (PCT/ISA/210) with translation and Written Opinion (PCT/ISA/237) mailed Dec. 15, 2022, by the Chinese Patent Office as the International Searching Authority for International Application No. PCT/CN2022/123101. (10 pages).

* cited by examiner

WASHING MACHINE AND CONTROL METHOD THEREFOR

FIELD

The invention belongs to the technical field of washing machine, and in particular relates to a washing machine and a control method.

BACKGROUND

During the washing process of the laundry by the washing machine, the lint is produced from the laundry fall into the washing water due to the friction between the laundry and between the laundry and the washing machine. If the lint in the washing water cannot be removed, the lint is likely to adhere to the surface of the laundry after washing, so the washing effect of the laundry is affected. For this reason, a filter for filtering lint is installed on the existing washing machine. Washing water passes repeatedly through the filter during the washing process to remove lint from the washing water.

The filter of the existing washing machine is generally arranged inside the inner tub or the drain pump, and is used to filter lint and sundries in the washing water. However, after the washing machine has been used for a long time, the filter will be filled with lint and debris, which will affect the filtering effect of the filter, cause the blockage of the drain valve/drain pump, and easily breed bacteria, so it needs to be cleaned in time, otherwise It will pollute the washing water, cause secondary pollution to laundry, and affect the health of users. However, the filters of most washing machines need to be detached to be manually cleaned by users, which is inconvenient to operate.

For this reason, a filter with a self-cleaning function has been proposed in the prior art. In order to discharge the sewage after cleaning the filter, a pipeline correspondingly needs to be added. In addition, for the solution that a filter is installed inside a draining pump or outside an outer cylinder, it is also necessary to install a circulation pipeline for circulating washing water in a washing machine to circularly filter the washing water, which makes the waterways inside the washing machine be more complicated and even take up a large space inside the washing machine. In a result, the space for accommodating laundry in the washing machine can be affected.

At the same time, the complexity of the waterways is increased and causes the on-off control of the waterways to be more complex. If a control valve is installed on each of the waterways that needs to be controlled, the number of the driving device arranged in the washing machine is increased since the control valve is driven to open and close by a driving device, resulting in an increase in production cost. On the other hand, each of the control valves is separately controlled, so the wires inside the washing machine are also more complicated, the difficulty of assembly is increased, and the control logic is also more complicated.

In view of this, the present invention is proposed.

SUMMARY

The problem to be solved by the present invention is to overcome the deficiencies of the prior art, and a washing machine and a control method of a washing machine are provided. A control valve assembly is set to simultaneously control the water holding barrel to be connected with and disconnected from the water inlet of the filter device, and the sewage outlet of the filter device to be connected with and disconnected from the sewage pipeline, so that the filter device can be switched to operate between two working processes of filtration and sewage, which simplifies the control structure of the waterways.

In order to solve the problems, the present invention adopts the following basic idea of technical solution.

A washing machine, including:

- a water holding barrel;
- a circulation filtration pipeline, of which a water inlet end and a water outlet end are respectively connected with the water holding barrel;
- a filter device, arranged in the circulation filtration pipeline, and having a water inlet, a filtered water outlet and a sewage outlet;
- a sewage pipeline, being used for receiving the sewage discharged from the sewage outlet;
- a control valve assembly, arranged between the water inlet end of the circulation filtration pipeline and the filter device, wherein the control valve assembly includes a first valve chamber and a second valve chamber that are independent from each other, and the first valve chamber communicates with the water holding barrel and the water inlet of the filter device, and the second valve chamber communicates with the sewage pipeline and the sewage outlet of the filter device; wherein,
- in a first working state, the control valve assembly is connected with the water holding barrel and the water inlet, and disconnected from the sewage outlet and the sewage pipeline; in a second working state, the control valve assembly is disconnected from the water holding barrel and the water inlet, and connected with the sewage outlet and the sewage pipeline.

As an embodiment, the control valve assembly includes a valve body, and a first valve chamber and a second valve chamber are formed inside the valve body, which are independent from each other.

The first valve chamber is provided with a water inlet connected with the water holding barrel, and a circulation water outlet connected with the water inlet. The second valve chamber is provided with a sewage inlet connected with the sewage outlet, and a sewage outlet connected with the sewage pipeline.

The valve body is provided with a switch mechanism. In the first working state, the switch mechanism opens the circulation water outlet and blocks the sewage inlet and/or sewage outlet. In the second working state, the switch mechanism blocks the circulation water outlet, and opens the sewage inlet and the sewage outlet.

Preferably, the sewage outlet is normally open, the switch mechanism blocks the sewage inlet in the first working state, and the switch mechanism opens the sewage inlet in the second working state.

As an embodiment, the washing machine further includes an external drainage pipeline for draining water to the outside. The first valve chamber is further provided with a discharge port connected with the external drainage pipeline.

In the first working state, the switch mechanism blocks the discharge port; in the second working state, the switch mechanism opens the discharge port.

As an embodiment, the switch mechanism includes:

- a flap, rotatably installed inside the valve body, having a first surface and a second surface opposite to each other;

a drainage sealing component, arranged on the first surface of the flap and located inside the first valve chamber, and being used to block the discharge port;

a sewage sealing component, arranged on the first surface of the flap and located inside the second valve chamber, and being used to block the sewage inlet; and a circulation sealing component, arranged on the second surface of the flap and located inside the first valve chamber, and being used to block the circulation water outlet.

The discharge port and the sewage inlet are provided on the same side surface of the valve body. In the first working state, the drainage sealing component and the sewage sealing component respectively block the discharge port and the sewage inlet. In the second working state, the flap rotates toward the direction away from the discharge port and the sewage inlet, until the circulation sealing component blocks the circulation water outlet.

As an embodiment, both the first valve chamber and the second valve chamber of the control valve assembly have an extension length, and the extension directions of the two extension lengths are parallel to each other.

The discharge port is arranged on a sidewall of the first valve chamber in the extension direction, and the sewage inlet is arranged on a sidewall of the second valve chamber in the extension direction.

Preferably, the water inlet is arranged on another sidewall of the first valve chamber, and parallel to and opposite to an orientation of the discharge port. The sewage outlet is arranged on another sidewall of the second valve chamber, and is parallel to and opposite to an orientation of the sewage inlet.

As an embodiment, the orientation of the circulation water outlet is perpendicular to the orientation of the discharge port. The first working state of the control valve assembly is switched to the second working state, and the flap rotates by 90° around a rotation axis.

Preferably, the circulation water outlet is disposed on the sidewall of the first valve chamber extending along the length direction, and the sidewall where the circulation water outlet is located is adjacent to the sidewall of the second valve chamber.

As an embodiment, the switch mechanism also includes a driving member for driving the flap to rotate in the valve body.

Preferably, the driving member includes a driving motor disposed outside the valve body.

As an embodiment, a circulation pump is arranged between the water inlet end of the circulation filtration pipeline and the control valve assembly.

Another object of the present invention is to provide a control method for the above-mentioned washing machine comprising, switching the control valve assembly to be in the first working state, so water in the water holding barrel enters the filter device through the first valve chamber for filtering, and a filtered water flows back to the water holding barrel; and switching the control valve assembly to be in the second working state, so the sewage in the filter device is discharged into the sewage pipeline through the second valve chamber.

As an embodiment, the washing machine also includes an external drainage pipeline for draining water to an outside. The first valve chamber is provided with a circulation water outlet connected with a water inlet, and a discharge port connected with the external drainage pipeline.

The control valve assembly is switched to be in the first working state, the circulation water outlet is opened and the discharge port is blocked, so the water in the water holding barrel is delivered into the first valve chamber, and discharged into the filter device from the circulation water outlet.

The control valve assembly is switched to be in the second working state, the circulation water outlet is blocked and the discharge port is opened, so the water in the water holding barrel is delivered into the first valve chamber, discharged from the discharge port, and discharged to the outside of the washing machine through the external drainage pipeline.

After adopting the above technical solution, the present invention has the following advantages compared with the prior art.

In the present invention, the washing machine is provided with a control valve assembly being switched between the first working state and the second working state. The control valve assembly can controls the water holding barrel to be connected with and disconnected from the water inlet of the filter device, and controls the sewage outlet of the filter device to be connected with and disconnected from the sewage pipeline, which are the two independent waterways to be controlled at the same time. So the filter device can be switched to perform two working processes of filtration and sewage discharge, which can simplify the control structure of the waterways in the washing machine and be beneficial for reducing production costs.

In the present invention, the valve body of the control valve assembly is provided with a plurality of openings for allowing water to flow in and out, which respectively communicate with the corresponding first valve chamber and the second valve chamber. The switch mechanism drives the flap to move by one driving motor, to simultaneously control to open and block the plurality of openings, which has a simple structure and controls simultaneously to drain water from the water holding barrel and drain the sewage from the filter device. Thereby the working efficiency of the washing machine is improved.

The specific implementation manners of the present invention are further described in detail below in conjunction with the accompanying drawings.

DESCRIPTION OF DRAWINGS

The accompanying drawings, as a part of the present invention, are used to further understand the present invention. The embodiments of the present invention and their descriptions are used to explain the present invention, but do not improperly limit to the present invention. Apparently, the drawings in the following description are only some embodiments, and those skilled in the art can also obtain other drawings according to these drawings without creative efforts. In the figures.

Figure 1:
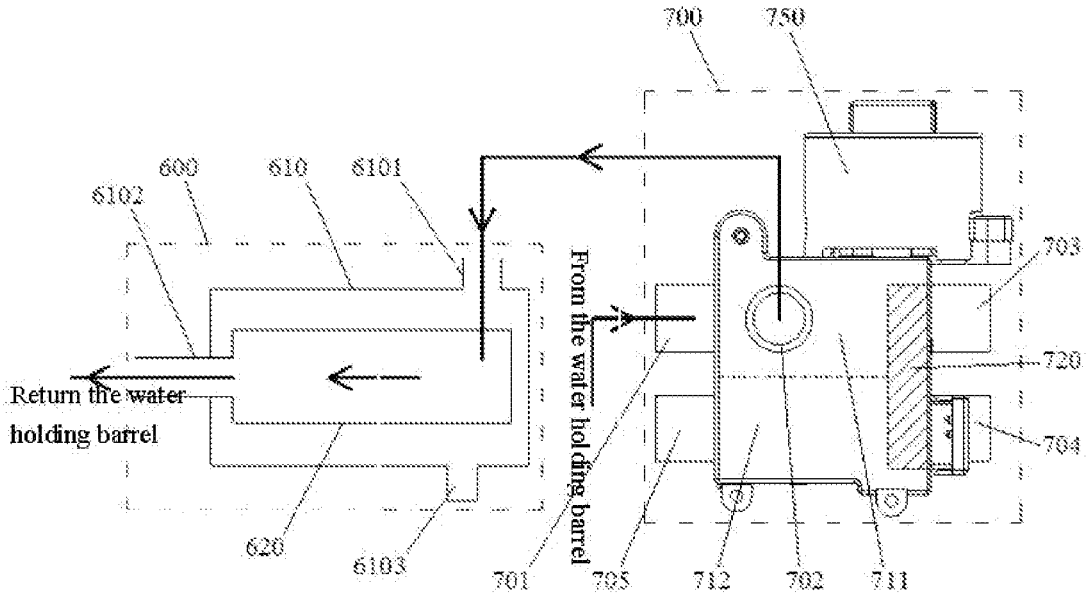
FIG. 1 is a schematic diagram of a waterway connection structure in a first working state of a control valve assembly in an embodiment of the present invention.
Figure 2:
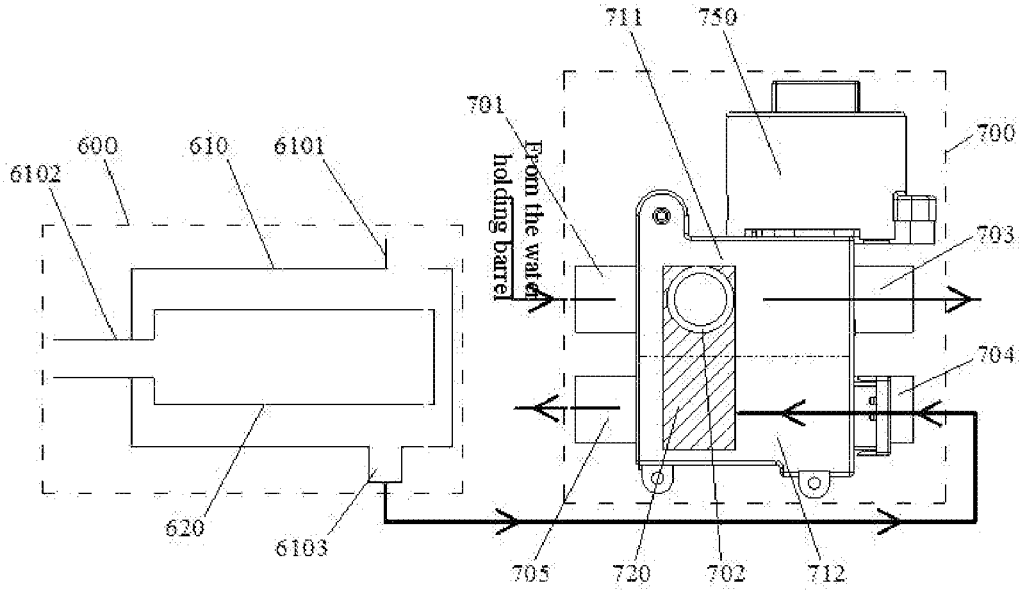
FIG. 2 is a schematic diagram of a waterway connection structure in a second working state of a control valve assembly in an embodiment of the present invention.

In the figure: 10. box body; 100. water holding barrel; 110. window pad; 210. drainage pipeline; 220. circulation pipeline; 230. return water pipeline; 231. return water control valve; 240. sewage pipeline; 250. external drainage pipeline; 260. drainage pipe of the water holding barrel; 280. connecting pipeline; 400. circulation pump; 500. recovery device; 501. filtered impurities; 510. housing; 520. filter assembly; 531. first chamber; 532. second chamber;

600. filter device; 601. first limiting surface; 602. second limiting surface; 603. third limiting surface; 604. fourth limiting surface; 605. fifth limiting surface; 606. sixth limiting surface; 610. filter chamber; 6101. water inlet; 6102. filtered water outlet; 6103. sewage outlet; 6104. installation port; 611. sealing support part; 612. sleeve part; 613. reinforcing rib; 620. filter mechanism; 621. water outlet joint; 622. rotation support part; 623. filter screen support part; 624. motor installation part; 625. filter screen; 631. first bearing; 632. second bearing; 641. first sealing member; 642. second sealing member; 643. third sealing member; 650. filter chamber flange; 651. connection portion; 652. insertion portion; 653. through-opening; 660. driving mechanism;

700. control valve assembly; 701. water inlet; 702. circulation water outlet; 703. discharge port; 704. sewage inlet; 705. sewage outlet; 710. valve body; 711. first valve chamber; 712. second valve chamber; 720. switch mechanism; 732. circulation sealing component; 733. drainage sealing component; 740. flap; 741. first surface; 742. second surface; 750. driving motor.

It should be noted that these drawings and descriptions are not intended to limit the scope of the present invention in any way, but illustrate the concept of the present invention for those skilled in the art by referring to specific embodiments.

DETAILED DESCRIPTION

In order to make objects, technical solutions and advantages of the embodiments of the present invention clearer, the solutions in the embodiments are clearly and completely described as follows in combination with accompanying drawings in the embodiments of the present invention. The following embodiments are used for illustrating the present invention, rather than limiting the scope of the present invention.

In the description of the present invention, it should be noted that, the orientation or positional relationship indicated by such terms as "up", "down", "front", "rear", "left", "right", "vertical", "inner" and "outer" is the orientation or positional relationship based on the accompanying drawings. Such terms are merely used for conveniently and simplified describing the present invention, rather than indicating or implying that the device or element referred to must be located in a certain orientation or must be constructed or operated in a certain orientation. Therefore, the terms cannot be understood as a limitation to the present invention.

In the description of the present invention, it should be noted that, unless otherwise stipulated and defined definitely, such terms as "installed", "connected" and "in connection" should be understood in their broad sense, e.g., the connection can be a fixed connection, a detachable connection or an integral connection; can be mechanical connection or electrical connection; and can be direct connection or can be indirect connection through an intermediate. For those skilled in the art, specific meanings of the above terms in the present invention can be understood according to specific conditions.

Embodiment 1

As shown in FIGS. 1 to 5, a washing machine in this embodiment includes:

- a water holding barrel 100;
- a circulation filtration pipeline, of which a water inlet end and a water outlet end are respectively connected with the water holding barrel 100;
- a filter device 600, arranged in the circulation filtration pipeline, and having a water inlet 6101, a filtered water outlet 6102 and a sewage outlet 6103;
- a sewage pipeline 240, being used for receiving the sewage discharged from the sewage outlet 6103;
- a control valve assembly 700, arranged between the water inlet end of the circulation filtration pipeline and the filter device 600, wherein the control valve assembly includes a first valve chamber 711 and a second valve chamber 712 that are independent from each other, and the first valve chamber 711 communicates with the water holding barrel 100 and the water inlet 6101 of the filter device 600, and the second valve chamber 712 communicates with the sewage pipeline 240 and the sewage outlet 6103 of the filter device 600.

The control valve assembly 700 of this embodiment has two different working states. In a first working state, the control valve assembly 700 is connected with the water holding barrel 100 and the water inlet 6101, and disconnected from the sewage outlet 6103 and the sewage pipeline 240. In a second working state, the control valve assembly 700 is disconnected from the water holding barrel 100 and the water inlet 6101, and connected with the sewage outlet 6103 and the sewage pipeline 240.

In this embodiment, a circulation pump 400 is arranged between the water inlet end of the circulation filtration pipeline and the control valve assembly 700. A control method of the washing machine includes:

- switching the control valve assembly 700 to be in the first working state, turning on the circulation pump 400, so water in the water holding barrel 100 enters the filter device 600 through the first valve chamber 711 for filtering, and a filtered water flows back to the water holding barrel 100;
- switching the control valve assembly 700 to be in the second working state, so the sewage in the filter device 600 is discharged into the sewage pipeline 240 through the second valve chamber 712.

In the above solution, the control valve assembly 700 controls the water holding barrel 100 to be connected with and disconnected from the water inlet 6101 of the filter device 600, and controls the sewage outlet 6103 of the filter device 600 to be connected with and disconnected from the sewage pipeline 240. By switching the working state of the control valve assembly 700, the filter device 600 can be switched to perform two working processes of filtration and sewage discharge. The control valve assembly 700 can simultaneously control the on-off conditions of two independent waterways, which is beneficial to simplify the arrangement of the waterways in the washing machine, and the control logic on the on-off of the waterways is simpler.

In this embodiment, the control valve assembly 700 includes a valve body 710, and a first valve chamber 711 and a second valve chamber 712 are formed inside the valve body 710, which are independent from each other.

The first valve chamber 711 is provided with a water inlet 701 connected with the water holding barrel 100, and a circulation water outlet 702 connected with the water inlet 6101. The second valve chamber 712 is provided with a sewage inlet 704 connected with the sewage outlet 6103 and a sewage outlet 705 connected with the sewage pipeline 240.

The valve body 710 is provided with a switch mechanism 720. In the first working state, the switch mechanism 720 opens the circulation water outlet 702 and blocks the sewage inlet 704 and/or sewage outlet 705. In the second working state, the switch mechanism 720 blocks the circulation water outlet 702, and opens the sewage inlet 704 and the sewage outlet 705.

In preferred solution of this embodiment, the sewage outlet 705 is normally open, the switch mechanism 720 blocks the sewage inlet 704 in the first working state, and the switch mechanism 720 opens the sewage inlet 704 in the second working state.

Specifically, a partition is arranged in the valve body 710 of the control valve assembly 700 to divide the internal space of the valve body 710 into the first valve chamber 711 and the second valve chamber 712 that are independent from each other. The switch mechanism 720 runs through the first valve chamber 711 and the second valve chamber 712, so as to realize simultaneously to control both valve chambers. Since the switch mechanism 720 needs to move inside the valve body 710, after the control valve assembly 700 is used for a long time, the sealing performance of the position where the switch mechanism 720 runs through the first valve chamber 711 and the second valve chamber 712 may be decreased. It is a result that there is water leakage between the first valve chamber 711 and the second valve chamber 712.

In this embodiment, the sewage outlet 705 is set to be normally open, and the switch mechanism 720 controls the sewage inlet 704 to be open/blocked to or not to discharge sewage in the filter device 600 to the sewage pipeline 240. When the control valve assembly 700 is in the first working state, the water in the water holding barrel 100 enters into the first valve chamber 711. Even if there is water leakage from the first valve chamber 711 to the second valve chamber 712, there is no water flow from the sewage outlet 6103 into the filter device 600 since the sewage inlet 704 is blocked and the sewage outlet 6103 is disconnected from the second valve chamber 712.

In the specific solution of this embodiment, the filter device 600 includes:

- a filter chamber 610, having a water inlet 6101, a filtered water outlet 6102 and a sewage outlet 6103;
- a filter mechanism 620, rotatably arranged inside the filter chamber 610;
- a driving mechanism 660, connected with the filter mechanism 620 and used to drive the filter mechanism 620 to rotate in the filter chamber 610.

The filter mechanism 620 divides the inside of the filter chamber 610 into an outer chamber and an inner chamber, wherein the water inlet 6101 communicates with the outer chamber, and the filtered water outlet 6102 communicates with the inner chamber. When the control valve assembly 700 is switched to be in the first working state, the water in the water holding barrel 100 enters the outer chamber through the water inlet 6101 under the action of the circulation pump 400, and enters the inner chamber through the filter mechanism 620 to realize filtration, and the lint carried in the water is attached to the outer wall of the filter mechanism 620.

The driving mechanism 660 drives the filter mechanism 620 to rotate, to stir the water flow in the filter chamber 610, so that the lint attached to the outer wall of the filter mechanism 620 is peeled off under the double action of centrifugal force and turbulent water flow, and mixed into the water in the filter chamber 610. When the control valve assembly 700 is switched to the second working state, the sewage inlet 704 is opened, the sewage outlet 6103 is connected with the sewage pipeline 240, so the sewage carrying lint can be discharged from the sewage outlet 6103 and enter in the sewage pipeline 240 through the second valve chamber 712.

In detail, the circulation filtration pipeline of the washing machine in this embodiment specifically includes:

- a drainage pipe 260 of the water holding barrel, connected with the water holding barrel 100 and the water inlet end of the circulation pump 400;
- a drainage pipeline 210, of which one end is connected with the water outlet of the circulation pump 400 and the other end is connected with the water inlet 701 of the control valve assembly 700;
- a circulation pipeline 220, of which one end is connected with the circulation water outlet 702 of the control valve assembly 700, and the other end is connected with the water inlet 6101 of the filter device 600;
- a return water pipeline 230, of which one end is connected with a filtered water outlet 6102 of the filter device 600, and the other end is connected with the water holding barrel 100, so that the filtered water is delivered to the water holding barrel 100.

In this embodiment, the return water pipeline 230 is specifically connected to the window pad 110 at the opening of the water holding barrel 100.

The sewage outlet 6103 of the filter device 600 is connected with the connecting pipeline 280, the connecting pipeline 280 is connected with the sewage inlet 704 of the control valve assembly 700, and the water inlet end of the sewage pipeline 240 is connected with the sewage outlet 705 of the control valve assembly 700, to form a channel for discharging the sewage out of the filter device 600.

Preferably, a return water control valve 231 is provided in the return water pipeline 230 for controlling the on-off of the return water pipeline 230. When the control valve assembly 700 is switched to be in the second working state, the return water control valve 231 is closed to cut off the return water pipeline 230 to ensure that the water in the filter chamber 610 cannot flow out from the filter water outlet 6102. So it is beneficial that the residual water in the filter device 600 are fully discharged.

In a further solution of this embodiment, the washing machine further includes an external drainage pipeline 250 for draining water to the outside. The first valve chamber 711 is further provided with a discharge port 703 connected with the external drainage pipeline 250.

In the first working state, the switch mechanism 720 blocks the discharge port 703; in the second working state, the switch mechanism 720 opens the discharge port 703.

Correspondingly, a control method of the washing machine includes:

- switching the control valve assembly 700 to be in the first working state, opening the circulation water outlet 702 and blocking the discharge port 703, and turning on the circulation pump 400, so the water in the water holding barrel 100 is delivered into the first valve chamber 711, and discharged into the filter device 600 from the circulation water outlet 702;

switching the control valve assembly 700 to be in the second working state, blocking the circulation water outlet 702 and opening the discharge port 703, and turning on the circulation pump 400, so the water in the water holding barrel 100 is delivered into the first valve chamber 711, discharged from the discharge port 703, and discharged to the outside of the washing machine through the external drainage pipeline 250.

Specifically, during the washing/rinsing process of the washing machine, the control valve assembly 700 is switched to be in the first working state, the return water control valve 231 is opened, and the circulation pump 400 is turned on. So the water in the water holding barrel 100 is discharged to the control valve assembly 700 and is discharged from the circulation water outlet 702, enters the filter device 600 for filtering out the lint, and then returns to the water holding barrel 100 through the return water pipeline 230.

After the washing/rinsing is finished, the control valve assembly 700 is switched to be in the second working state, the return water control valve 231 is closed, and the circulation pump 400 is turned on. So the water in the water holding barrel 100 is discharged to the control valve assembly 700 and is discharged from the discharge port 703, and then is discharged out of the washing machine through the external discharge pipeline 250. At the same time, since the sewage inlet 704 of the control valve assembly 700 is open, the sewage carrying lint in the filter chamber 610 is discharged from the sewage outlet 6103, enters the second valve chamber 712 of the control valve assembly 700 through the sewage inlet 704, and is discharged into the sewage pipeline 240 through by the sewage outlet 705.

In the above solution, the filter device 600 can automatically peel off filtered impurities such as lint remaining inside the filter device in the circulation filtration process, so it is no need for the user to manually clean the filter device 600. When the control valve assembly 700 is in the second working state, the water inlet 701 communicates with the discharge port 703, and the sewage inlet 704 communicates with the sewage outlet 705. The water in the water holding barrel is discharged to the outside of the washing machine, and the sewage in the filter device 600 is discharged to the outside, which improves the working efficiency of the washing machine and improves user's experience.

Figure 3:
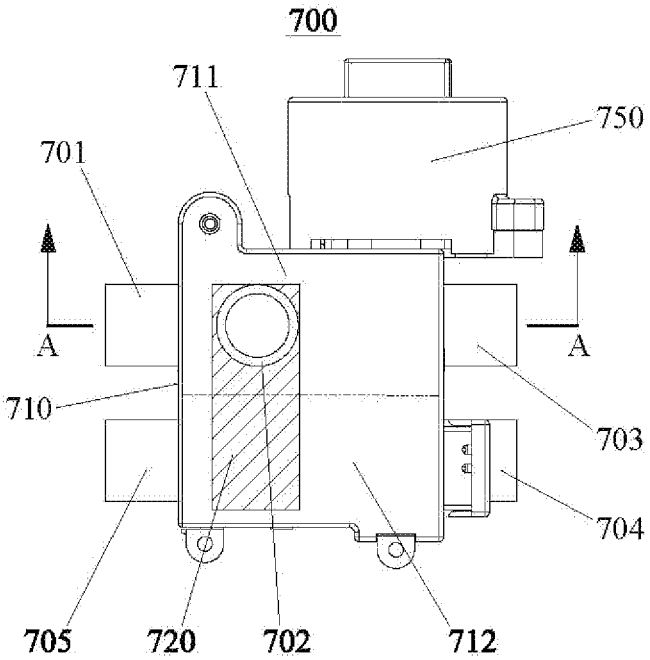
FIG. 3 is a schematic structural view (second working state) of a control valve assembly in an embodiment of the present invention.
Figure 4:
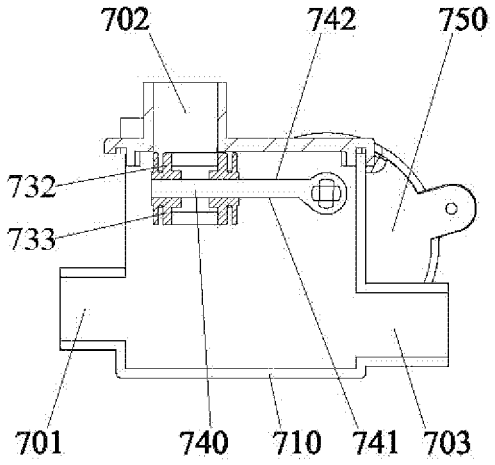
FIG. 4 is a schematic diagram of A-A section of FIG. 3 of the present invention.

In the specific solution of this embodiment, as shown in FIG. 3 and FIG. 4, the switch mechanism 720 includes:

a flap 740, rotatably installed inside the valve body 710, having a first surface 741 and a second surface 742 opposite to each other;

a drainage sealing component 733, arranged on the first surface 741 of the flap 740 and located inside the first valve chamber 711, and being used to block the discharge port 703;

a sewage sealing component, arranged on the first surface 741 of the flap 740 and located inside the second valve chamber 712, and being used to block the sewage inlet 704; and a circulation sealing component 732, arranged on the second surface 742 of the flap 740 and located inside the first valve chamber 711, and being used to block the circulation water outlet 702.

The discharge port 703 and the sewage inlet 704 are provided on the same side surface of the valve body 710. In the first working state, the drainage sealing component 733 and the sewage sealing component respectively block the discharge port 703 and the sewage inlet 704. In the second working state, the flap 740 rotates toward the direction away from the discharge port 703 and the sewage inlet 704, until the circulation sealing component 732 blocks the circulation water outlet 702.

The switch mechanism 720 also includes a driving member for driving the flap 740 to rotate in the valve body 710. Specifically, the driving member includes a driving motor 750 disposed outside the valve body 710.

The driving motor 750 is arranged outside the valve body 710, so the driving motor is avoided being contact with water and is safer. In the control valve assembly 700, the flap 740 is driven to move by the driving motor 750, and can simultaneously control to switch to open and block the circulation water outlet 702, the discharge port 703 and the sewage inlet 704. The control valve assembly 700 has a simple structure. Compared with the solution in the prior art in which a control valve which a driving member is respectively provided for each independent waterway, the cost of the present application is effectively saved.

In this embodiment, both the first valve chamber 711 and the second valve chamber 712 of the control valve assembly 700 have a certain extension length, and the extension directions of the two lengths are parallel to each other. Specifically, the first valve chamber 711 and the second valve chamber 712 extend left and right and are arranged parallel to each other.

The discharge port 703 is arranged on the right sidewall of the first valve chamber 711 in the extension direction, and the sewage inlet 704 is arranged on the right sidewall of the second valve chamber 712.

Preferably, the water inlet 701 is arranged on the left sidewall of the first valve chamber 711, and parallel to and opposite to the orientation of the discharge port 703. The sewage outlet 705 is arranged on the left sidewall of the second valve chamber 712, and is parallel to and opposite to the orientation of the sewage inlet 704. When the control valve assembly 700 is in the second working state, the water flows from left to right in the first valve chamber 711 and from right to left in the second valve chamber 712, and the resistance of the water flow is small, so it is smoother that water is discharged out of the washing machine and the sewage is discharged out of the filter device 600.

The orientation of the circulation water outlet 702 is perpendicular to the orientation of the discharge port 703. The first working state of the control valve assembly 700 is switched to the second working state, and the flap 740 rotates by 90° around its rotation axis.

Preferably, the circulation water outlet 702 is disposed on the sidewall of the first valve chamber 711 extending along the length direction, and the sidewall where the circulation water outlet 702 is located is adjacent to the sidewall of the second valve chamber 712.

Specifically, in this embodiment, taking the orientation in FIG. 3 as an example, the first valve chamber 711 is arranged above the second valve chamber 712, the circulation water outlet 702 is arranged on the front sidewall of the first valve chamber 711, and the front sidewall of the first valve chamber 711 is adjacent to the front sidewall of the second valve chamber 712.

When the control valve assembly 700 is in the first working state, the flap 740 is nearly parallel to the right sidewalls of the first valve chamber 711 and the second valve chamber 712, so that the drainage sealing component 733 blocks the discharge port 703 and the sewage sealing component blocks the sewage inlet 704. When the control valve assembly 700 is switched to be in the second working state, the driving motor 750 drives the flap 740 to rotate forward by 90°, so that the circulation sealing component 732 blocks the circulation water outlet 702. At this time, the drainage sealing component 733 is separated from the discharge port 703 to open the discharge port 703; and the sewage sealing component is separated from the sewage inlet 704 to open the sewage inlet 704.

In this embodiment, a control valve assembly 700 is arranged in the washing machine. By one driving motor 750, the water in the water holding barrel 100 is controlled to be delivered to the filter device 600 or to the external discharge pipeline 250, and at the same time the sewage in the filter device 600 is controlled to be or not be discharged to the outside through the sewage outlet 6103. By the same one control valve assembly 700, the washing machine is controlled to operate the circularly filtering process and the drainage process, and the filtering device 600 is controlled to operate the sewage drainage process. The waterway structure inside the washing machine is simplified, the space occupied is saved, and the cost is reduced.

Embodiment 2

Figure 5:
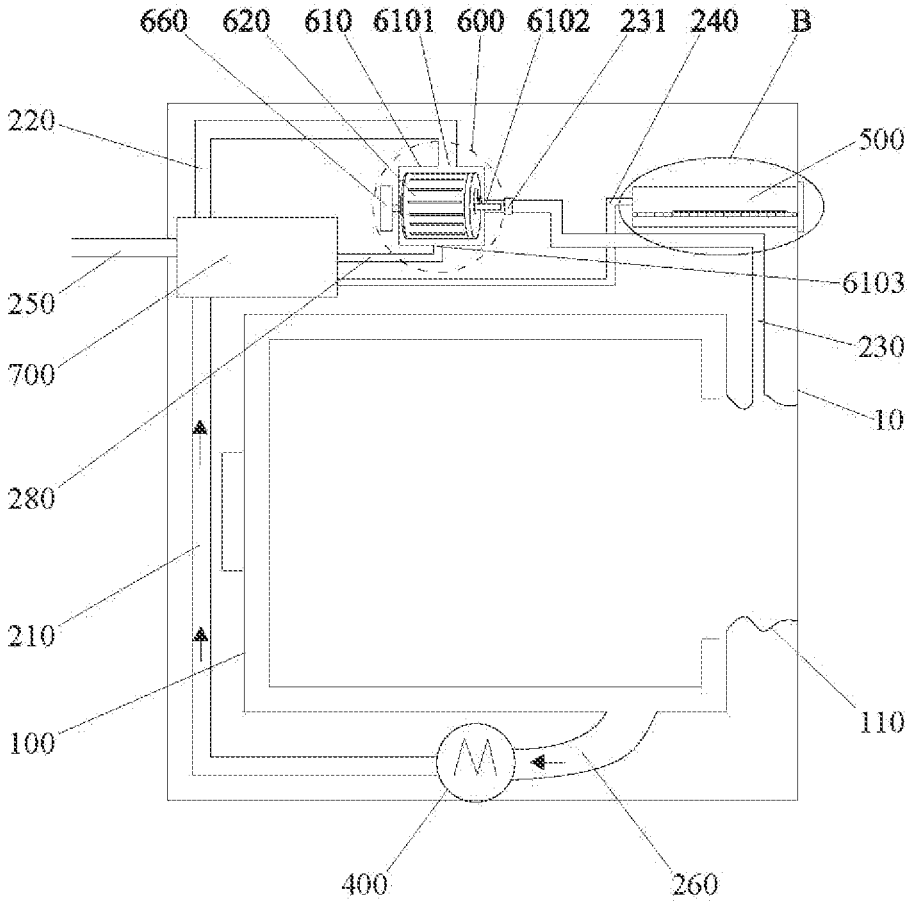
FIG. 5 is a schematic diagram of a washing machine in an embodiment of the present invention.
Figure 6:
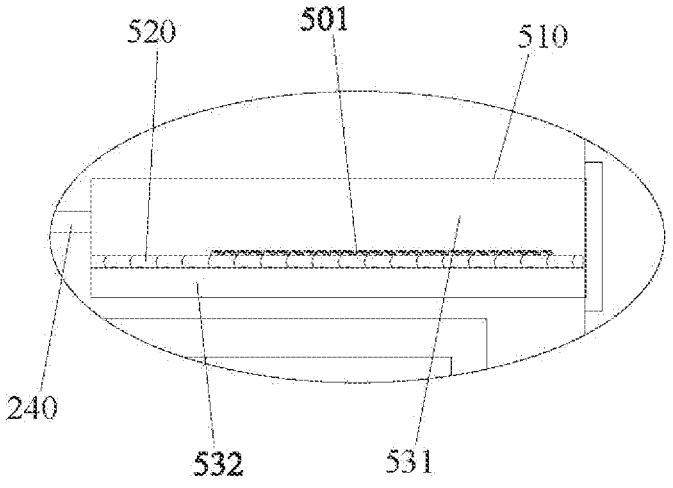
FIG. 6 is an enlarged schematic diagram of place B in FIG. 5 of the present invention.

As shown in FIGS. 5 and 6, this embodiment is a further limitation based on the above embodiment 1. A washing machine also includes a recovery device 500, and the recovery device 500 is connected with the water outlet of the sewage pipeline 240 for collecting the sewage discharged from the filter device 600.

Specifically, the recovery device 500 is used to collect filtered impurities 501 such as lint in the sewage discharged.

There may be fine lint in the filtered impurities 501. If the sewage carrying the filtered impurities 501 is directly mixed into the water flow drained out of the washing machine and drained out of the washing machine, the fine lint will enter the ecological cycle, and further affect the ecological environment and the health of human.

A washing machine of this embodiment is provided with a recovery device 500. After the sewage carrying the filtered impurities 501 is discharged from the sewage outlet 6103, the sewage flows in the recovery device 500 through the sewage pipeline 240 to be collected, not enters the drainage water flow and be discharged out of washing machine along the drainage water flow.

In a further solution of this embodiment, the recovery device 500 includes:

a housing 510, having a recovery chamber inside;

a filter assembly 520, arranged in the recovery chamber and dividing the recovery chamber into a first chamber 531 and a second chamber 532.

The sewage outlet 6103 of the filter device 600 communicates with the first chamber 531. The sewage carrying the filtered impurities 501 enters the first chamber 531, and enters the second chamber 532 after being filtered by the filter assembly 520. The filtered impurities 501 are collected in the first chamber 531.

In the above solution, the recovery device 500 is provided with a filter assembly 520 for filtering the sewage discharged from the filter device 600 and separating the filtered impurities 501 from the water. The interior of the recovery device 500 is divided into a first chamber 531 and a second chamber 532 by the filter assembly 520, and the filtered impurities 501 in the sewage are blocked by the filter assembly 520, thereby collecting the filtered impurities 501 on the upper surface of the filter assembly 520 in the first chamber 531. The cleaning water after filtration is collected in the second chamber 532. User can directly collect the filtered impurities 501 separated from water, so the situation is avoided that the filtered impurities 501 are mixed in water and cannot be effectively treated.

Specifically, the filter assembly 520 may be a frame horizontally arranged at a certain height in the recovery chamber and a filter net covering on the frame. After the sewage carrying the filtered impurities 501 enters the first chamber 531, the water enters the second chamber 532 through the filter assembly 520, and the filtered impurities 501 are blocked by the filter net and remained on the upper surface of the filter assembly 520.

In this embodiment, the washing machine further includes a box body 10, and the water holding barrel 100 and the filter device 600 are both arranged in the box body 10. The recovery device 500 can be inserted in or extracted from the box body 10, and users can pull the recovery device 500 out of the box body 10 for cleaning.

Specifically, a housing 510 of the recovery device 500 can be inserted in or extracted from the box body 10, and an upper side of the housing 510 has an opening. When users pulls out the housing 510 from the box body 10, the filtered impurities 501 adhering to the upper surface of the filter assembly 520 can be cleaned through the opening on the upper side of the housing 510. The filter assembly 520 is preferably detachably connected with the housing 510, and users can disassemble the filter assembly 520 from the inside of the housing 510 and take it out for cleaning, so it is more convenient to operate.

In a preferred solution of this embodiment, a water outlet is provided on the second chamber 532 for discharging filtered clean water. Through the water outlet on the second chamber 532, the clear water in the second chamber 532 can be discharged from the recovery device 500 in time, so as to prevent the recovery device 500 from overflowing when the amount of sewage discharged from the filter device 600 is larger. Otherwise, the capacity of the second chamber 532 needs to be increased, that is, the volume of the recovery device 500 needs to be increased, resulting in that it occupies a large space in the washing machine. It is not beneficial to the miniaturization of the overall volume of the washing machine.

On the other hand, the water in the second chamber 532 can be automatically discharged from the water outlet. When users clean the recovery device 500, it is only needed to remove the filtered impurities 501 on the filter assembly 520 without pouring manually the clean water out of the second chamber 532. When the filter assembly 520 is detachably installed in the housing 510, users does not even need to completely take the housing 510 out from the box body 10 of the washing machine, only need to take out the filter assembly 520 for cleaning. So it is more convenient to operate.

In a preferred solution of this embodiment, the water outlet of the second chamber 532 may communicate with the return water pipeline 230, or directly communicate with the water holding barrel 100 through the pipeline.

Since the sewage entering the recovery device 500 is filtered by the filter assembly 520 in the recovery device 500, the filtered impurities 501 are removed, and the water collected in the second chamber 532 is clean without filtered impurities 501. The clean water is sent into the water holding barrel 100 to realize the reuse of part of clean water, thereby reducing the amount of feeding water required when the washing machine continues to run. So it is realized to save the water consumption of the washing machine.

In another preferred solution of this embodiment, the water outlet of the second chamber 532 may directly or indirectly be communicated with the outside of the washing machine. For example, the water outlet of the second chamber 532 is communicated with the external drainage pipeline 250 through a pipeline, and the water collected in the second chamber 532 is discharged out of the washing machine through the external drainage pipeline 250.

Since the water collected in the second chamber 532 is clean water without the filtered impurities 501, the clean water is directly discharged not to have the problem of the ecological cycle caused by fine lint.

In this embodiment, a recovery device 500 is installed in the washing machine. The sewage carrying the filtered impurities 501 discharged from the filter device 600 passes through the connecting pipeline 280, the control valve assembly 700 and the sewage pipeline 240 in turn, and then can flow into the recovery device 500 to be. collected, instead of mixing in the drainage water flow to be directly discharged from the washing machine. In this way, it is avoided that the fine lint in the filtered impurities 501 enters the ecological cycle with the drainage water flow, and affects the ecological environment and human health. The recovery device 500 is provided with the filter assembly 520 to filter the collected sewage, so as to separate the filtered impurities 501 from water, and facilitate to remove the filtered impurities 501.

Embodiment 3

Figure 7:
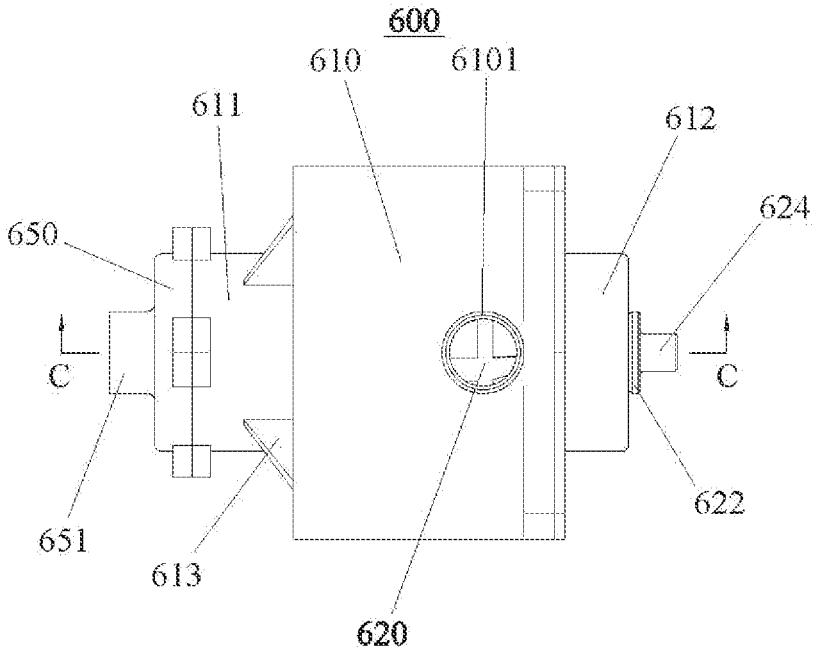
FIG. 7 is a schematic diagram of a filtering device in Embodiment 3 of the present invention.
Figure 8:
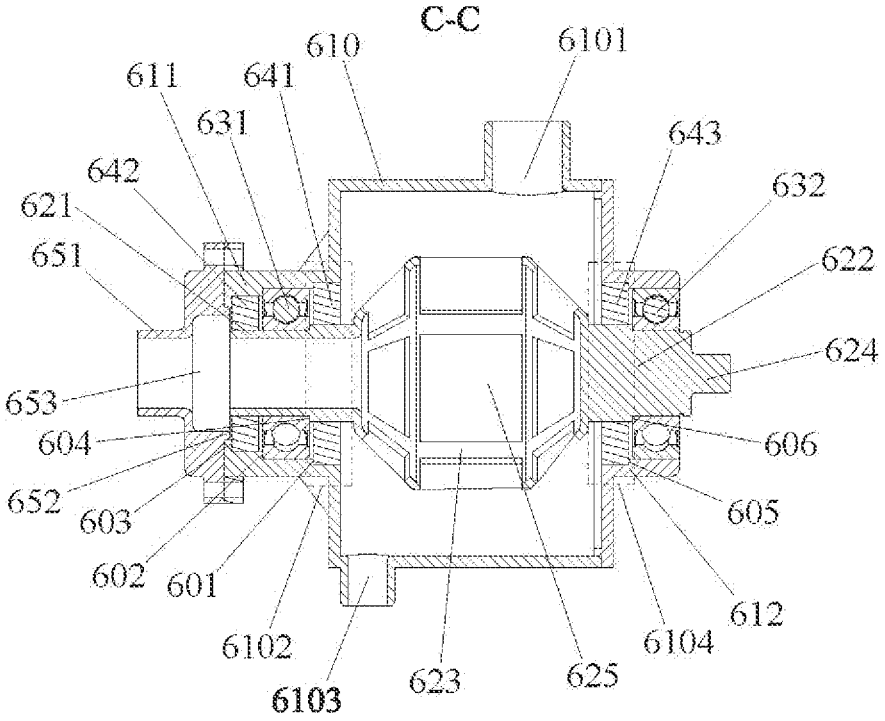
FIG. 8 is a schematic diagram of C-C section of FIG. 7 of the present invention.

As shown in FIG. 7 and FIG. 8, this embodiment is a further limitation of the filter device 600 based on the above embodiment 1 or 2. A periphery of the filtered water outlet 6102 of the filter device 600 extends outward the filter chamber 610 to form a sealing support part 611. One end of the filter mechanism 620 has a water outlet joint 621 inserted in the sealing support part 611, and the water outlet joint 621 is rotatably and sealingly connected with the sealing support part 611. A first bearing 631 is sleeved on the water outlet joint 621, and a first sealing member 641 is provided on a side of the first bearing 631 facing the inside of the filter chamber 610 to seal the gap between the water outlet joint 621 and the sealing support part 611.

Specifically, the filter mechanism 620 includes a filter screen support and a filter screen 625.

The filter screen support includes: a filter screen support part 623 located inside the filter chamber 610, and the filter screen 625 covering the surface of the filter screen support part 623;

the water outlet joint 621, being arranged at the left side of the filter screen support part 623 and rotatably inserted in the sealing support part 611; and a rotating supporting part 622, being arranged at the right side of the filter screen support part 623 and rotatably connected with the filtering chamber 610.

In the above solution, The first bearing 631 is arranged between the water outlet joint 621 and the sealing support part 611 to support the water outlet joint 621, so that the water outlet joint 621 can smoothly rotate in the sealing support part 611. It is ensured that the filter mechanism 620 is stably rotated in the filter chamber 610 due to the stable structure. The first sealing member 641 is arranged on the right side of the first bearing 631, so the washing water in the filter chamber 610 cannot enter the gap between the water outlet joint 621 and the sealing support part 611. The first bearing 631 is prevented from contacting with water, to avoid the failure of the first bearing 631 and ensure the function of the first bearing 631. At the same time, the first sealing member 641 also prevents unfiltered washing water from flowing out from the filtered water outlet 6102 through the sealing support part 611, which affects the efficiency of removing lint through the filter device 600.

In the specific solution of this embodiment, the first sealing member 641 is sleeved on the water outlet joint 621, the inner wall of the first sealing member 641 is in sealing connection with the outer wall of the water outlet joint 621, and the outer wall of the first sealing member 641 is rotatable and hermetically connected with the sealing support part 611.

In a further solution of this embodiment, the filter device 600 further includes a second sealing member 642. The second sealing member 642 is arranged on the side of the first bearing 631 opposite to the interior of the filter chamber 610, for covering the gap between the water outlet joint 621 and the sealing support part 611.

Specifically, the second sealing member 642 is sleeved on the water outlet joint 621, the inner wall of the second sealing member 642 is in sealing connection with the outer wall of the water outlet joint 621, and the outer wall of the second sealing member 642 is rotatable and hermetically with the inner wall of the sealing support part 611.

In the above solution, the water flowing out through the water outlet joint 621 can be blocked by the second sealing member 642 and does not contact with the first bearing 631. The first bearing 631 is located between the first sealing member 641 and the second sealing member 642, so that it is ensured that the installation environment of the first bearing 631 is water-free to the greatest extent, and avoided the rust of the first bearing 631 when contacting with water. Therefore the filter mechanism 620 can smoothly rotate.

In a further solution of this embodiment, the inner wall of the sealing support part 611 has a stepped structure. Annular structures are sequentially formed from the end of the sealing support part 611 to the outer side of the filter chamber 610, and the inner diameters of the annular structures are gradually decreased from the first limiting surface 601, the second limiting surface 602 and the third limiting surface 603.

The surface of the first sealing member 641 facing the outside of the filter chamber 610 abuts against the first limiting surface 601. The surface of the first bearing 631 facing outside the filtering chamber 610 abuts against the second limiting surface 602. The surface of the second sealing member 642 facing the outside of the filter chamber 610 abuts against the third limiting surface 603.

In the above solution, a plurality of vertical annular limiting surfaces are formed on the inner wall of the sealing support part 611 with a stepped structure, which respectively abut against the left surfaces of the first sealing member 641, the first bearing 631 and the second sealing member 642 to restrict the movement of the above three parts in the axial direction of the water outlet joint 621. So the match between the water outlet joint 621 and the sealing support part 611 is prevented from loosening during the rotation of the filter mechanism 620.

In the preferred solution of this embodiment, the outer diameter of the end of the water outlet joint 621 near the outside of the filter chamber 610 is smaller than the outer diameter of the other end. Annular structures are formed on the outer wall of the water outlet joint 621, and the fourth limiting surface 604 of the water outlet joint 621 is perpendicular to the axis of the water outlet joint 621. A surface of the first bearing 631 facing the inside of the filter chamber 610 abuts against the fourth limiting surface 604.

The outer diameter of the left end of the water outlet joint 621 is smaller than that of the right end, and the fourth limit surface 604 towards the left is formed at the abrupt change in the outer diameter and abuts against the right side surface of the first bearing 631. In this way, both sides of the first bearing 631 are limited by the limiting structures, and the structure is more stable.

In this embodiment, the end of the sealing support part 611 away from the filter chamber 610, that is, the left end of the sealing support part 611, is connected to the filter chamber flange 650. The middle of the filter chamber flange 650 has a through-opening 653 for being communicated with the water outlet joint 621. The outer periphery of the through-opening 653 is extended away from the sealing support portion 611 to form a connection portion 651.

Preferably, the surface of the filter chamber flange 650 facing the side of the sealing support part 611 has a protruding insertion portion 652, and the insertion portion 652 is inserted into the opening at the left end of the sealing support part 611.

In the above scheme, the left end of the sealing support part 611 is connected to the filter chamber flange 650, and the connection part 651 is formed on the filter chamber flange 650. The outer diameter of the connection part 651 is smaller than the outer diameter of the sealing supporting part 611, and the inner diameter of the connection part 651 is preferably equal to the inner diameter of the water outlet joint 621. When the filter device 600 is installed in the washing machine, the connection part 651 of the filter chamber flange 650 is connected with the return water pipeline. Compared with the way that the return water pipeline is directly connected to the left end of the sealing support part 611, the installation is easier.

The right side of the filter chamber flange 650 has the insertion portion 652 inserted into the opening of the left end of the sealing support part 611, which facilitates the positioning of the filter chamber flange 650 and the sealing support portion 611 during assembly. A number of fixing parts are respectively arranged on the periphery of the filter chamber flange 650 and the sealing support part 611, and the filter chamber flange 650 is fixed with the sealing support part 611 by screws passing through the fixing parts.

In a further solution of this embodiment, the rotation support part 622 at the right end of the filter mechanism 620 is extended toward the outside of the filter chamber 610 along the rotation axis, and the filter chamber 610 is provided with an installation port 6104 for allowing the rotation support part 622 to pass through. The rotation support part 622 is rotatably and hermetically connected with the installation port 6104.

In this embodiment, the filter mechanism 620 is driven to rotate by the drive mechanism. The drive mechanism is arranged the outside of the filter chamber 610, thereby avoiding being contact with washing water. The rotating support part 622 is protruded from the right end of the filter chamber 610, and a motor installation part 624 is provided at the right end of the rotation support part 622 for connecting with the drive mechanism, such as a motor.

Further, the outer circumference of the installation port 6104 is extended outward from the filter chamber 610 along the axis of the rotation support part 622 to form a sleeve portion 612. The third sealing member 643 is sleeved on the rotation support part 622. The inner wall of the third sealing member 643 is hermetically connected with the outer wall of the rotation support part 622, and the outer wall of the third sealing member 643 is rotatably and hermetically connected with the inner wall of the sleeve portion 612.

A second bearing 632 is provided between the sleeve part 612 and the rotating support part 622, and the second bearing 632 is sleeved on the rotating support part 622 and located on the side of the third sealing member 643 facing the outside of the filter chamber 610.

In the above solutions, the third sealing member 643 is used for preventing the water in the filter chamber 610 from leaking from the installation port 6104. The second bearing 632 can support the rotating support part 622, ensuring that the rotation of the rotating support part 622 relative to the sleeve part 612 is smoother. The second bearing 632 is arranged on the right side of the third sealing member 643 and does not contact with the water in the filter chamber 610.

In the preferred solution of this embodiment, the inner diameter of the end of the sleeve part 612 away from the filter chamber 610 is smaller than the inner diameter of the other end, the annular structure is formed on the inner wall of the sleeve part 612, and the fifth limiting surface 605 of the sleeve part 612 is perpendicular to the axis of the rotating support part 622. A surface of the third sealing member 643 facing the outside of the filter chamber 610 abuts against the fifth limiting surface 605.

The outer diameter of one end of the rotation support part 622 close to the filter chamber 610 is larger than the outer diameter of the other end, the annular structure is formed on the outer wall of the rotating support part 622, and a sixth limiting surface 606 of the rotation support part is perpendicular to the axis of the rotation support part 622. The surface of the second bearing 632 facing the inside of the filter chamber 610 abuts against the sixth limiting surface 606.

In the above solution, the inner diameter of the right end of the sleeve part 612 is smaller than the inner diameter of the left end, and the fifth limiting surface 605 toward the left side is formed at an abrupt change in the inner diameter of the sleeve part 612 and abuts against the right side surface of the third sealing member 643. The outer diameter of the right end of the rotating support part 622 is smaller than the outer diameter of the left end, and the sixth limiting surface 606 toward the right side is formed at an abrupt change in the outer diameter and abuts against the left surface of the second bearing 632. The above structure restricts the movement of the third sealing member 643 and the second bearing 632 in the axial direction of the rotating support part 622, and the structure is stable.

In this embodiment, the first sealing member 641, the second sealing member 642 and the third sealing member 643 are all oil seals. The right wall of the filter chamber 610 is arranged separately from the peripheral side wall. The filter mechanism 620, and the first sealing member 641, the second sealing member 642 and the first bearing 631 on the left side are first installed in the interior of the filter chamber 610 as a whole, and the third sealing member 643 and the second bearing 632 are installed on the right side of the filter chamber, and finally the right wall of the filter chamber 610 is buckled with the peripheral side wall fasten.

In this embodiment, the cross-sectional area of the middle region of the filter screen support part 623 is constant, and a cone structure is located on the left end and the right end, so that the partial surface of the filter screen 625 is inclined to facilitate to make the attached lint fall off.

In this embodiment, the direction of the water inlet 6101 and the sewage outlet 6103 on the filter chamber 610 is perpendicular to the axial direction of the filter mechanism 620.

Preferably, the filter chamber 610 has a cylindrical structure, the water inlet 6101 is arranged near the right end of the filter chamber 610, the sewage outlet 6103 is arranged near the left end of the filter chamber 610, and the water inlet

6101 and the sewage outlet 6103 are symmetrically located around the peripheral direction of filter chamber 610.

In the above solutions, the position of the water inlet 6101 is as far away from the water outlet joint 621 as possible, so that the area of the filter screen 625 can be fully utilized. The water inlet 6101 and the sewage outlet 6103 are set on the upper and the bottom respectively, and are staggered in the axial direction of the filter chamber 610, which is beneficial to fully discharge the sewage in the filter chamber 610 after cleaning the filter device 600.

In a further solution of this embodiment, the outer wall of the sealing support part 611 is provided with a reinforcing rib 613 extending in radial direction of the sealing support part 611, and the reinforcing rib 613 is connected with the surface of the filter chamber 610 where the filtered water outlet 6102 is located.

Since the sealing support part 611 is extended out from the left side of the filter chamber 610 by a certain length, the reinforcing rib 613 supports the peripheral side wall of the sealing support part on the outside, ensuring the strength of the sealing support part 611.

In the filter device 600 of this embodiment, both ends of the filter mechanism 620 are respectively provided with the first bearing 631 and the second bearing 632 for supporting, to ensure the smooth and stable rotation of the filter mechanism 620 in the filter chamber 610. At the same time, through the arrangement of the first sealing member 641, the second sealing member 642 and the third sealing member 643, the first bearing 631 and the second bearing 632 are prevented from being in contact with water, and failure of both is avoided.

The embodiments merely describe preferred embodiments of the present invention, rather than limiting the concept and scope of the present invention. The preferred embodiments are disclosed above, and not used for limiting the present invention. Under the premise of not departing from the idea of the present invention, various changes and improvements made to the technical solution of the present invention by those skilled in the art, such as simple amendment, equal change and modify according concept of the present invention, shall all fall within the protection scope of the present invention. The solutions in the above embodiments can be further combined or substituted.

What is claimed is:

1. A washing machine, including:

a water holding barrel;

a circulation filtration pipeline, wherein, a water inlet end and a water outlet end of the circulation filtration pipeline are respectively connected with the water holding barrel;

a filter device, arranged in the circulation filtration pipeline, and having a first water inlet, a filtered water outlet and a first sewage outlet;

a sewage pipeline, being used for receiving sewage discharged from the first sewage outlet;

a control valve assembly, arranged between the water inlet end of the circulation filtration pipeline and the filter device, wherein, the control valve assembly includes a valve body, and a first valve chamber and a second valve chamber that are independent from each other and are formed inside the valve body, the first valve chamber is provided with a second water inlet connected with the water holding barrel and a circulation water outlet connected with the first water inlet of the filter device, and the second valve chamber is provided with a second sewage outlet connected with the sewage pipeline and a sewage inlet connected with the first sewage outlet of the filter device; wherein, the valve body is provided with a switch mechanism, the switch mechanism is configured to, in a first working state, open the circulation water outlet and block the sewage inlet and/or the second sewage outlet, so the control valve assembly is connected with the water holding barrel and the first water inlet, and disconnected from the first sewage outlet and the sewage pipeline;

the switch mechanism is configured to, in a second working state, block the circulation water outlet, and open the sewage inlet and the second sewage outlet, so the control valve assembly is disconnected from the water holding barrel and the first water inlet, and connected with the first sewage outlet and the sewage pipeline.

2. The washing machine according to claim 1, wherein, the washing machine further includes an external drainage pipeline for draining water to the outside;

the first valve chamber is provided with a discharge port connected with the external drainage pipeline;

the switch mechanism blocks the discharge port in the first working state, and the switch mechanism opens the discharge port in the second working state.

3. The washing machine according to claim 2, wherein, the switch mechanism includes:

a flap, rotatably installed inside the valve body, having a first surface and a second surface opposite to each other;

a drainage sealing component, arranged on the first surface of the flap and located in the first valve chamber, and being used to block the discharge port;

a sewage sealing component, arranged on the first surface of the flap and located in the second valve chamber, and being used to block the sewage inlet; and a circulation sealing component, arranged on the second surface of the flap and located inside the first valve chamber, and being used to block the circulation water outlet; wherein, the discharge port and the sewage inlet are provided on a same side surface of the valve body, the drainage sealing component and the sewage sealing component respectively block the discharge port and the sewage inlet in the first working state, in the second working state, the flap is configured to rotate toward a direction away from the discharge port and the sewage inlet until the circulation sealing component blocks the circulation water outlet.

4. The washing machine according to claim 3, wherein, both the first valve chamber and the second valve chamber of the control valve assembly have an extension length, and extension directions of two extension lengths are parallel to each other;

the discharge port is arranged on a sidewall of the first valve chamber in the extension direction, and the sewage inlet is arranged on a sidewall of the second valve chamber in the extension direction.

5. The washing machine according to claim 4, wherein, an orientation of the circulation water outlet is perpendicular to the orientation of the discharge port; and the first working state of the control valve assembly is switched to the second working state, and the flap rotates by 90° around a rotation axis.

6. The washing machine according to claim 5, wherein, the circulation water outlet is disposed on the sidewall of the first valve chamber extending along the length direction, and the sidewall where the circulation water outlet is located is adjacent to the sidewall of the second valve chamber.

7. The washing machine according to claim 4, wherein, the second water inlet is arranged on another sidewall of the first valve chamber, and parallel to and opposite to an orientation of the discharge port; and the second sewage outlet is arranged on another sidewall of the second valve chamber, and is parallel to and opposite to an orientation of the sewage inlet.

8. The washing machine according to claim 3, wherein, the switch mechanism includes a driving member for driving the flap to rotate in the valve body.

9. The washing machine according to claim 8, wherein, the driving member includes a driving motor disposed outside the valve body.

10. The washing machine according to claim 1, wherein, a circulation pump is arranged between the water inlet end of the circulation filtration pipeline and the control valve assembly.

11. A control method for the washing machine according to claim 1, including:

switching the control valve assembly to be in the first working state, so water in the water holding barrel enters the filter device through the first valve chamber for filtering, and a filtered water flows back to the water holding barrel; and switching the control valve assembly to be in the second working state, so the sewage in the filter device is discharged into the sewage pipeline through the second valve chamber.

12. The control method for the washing machine according to claim 11, wherein, the washing machine includes an external drainage pipeline for draining water to an outside;

the first valve chamber is provided with a discharge port connected with the external drainage pipeline;

the control valve assembly is switched to be in the first working state, the circulation water outlet is opened and the discharge port is blocked, so the water in the water holding barrel is delivered into the first valve chamber, and discharged into the filter device from the circulation water outlet; and the control valve assembly is switched to be in the second working state, the circulation water outlet is blocked and the discharge port is opened, so the water in the water holding barrel is delivered into the first valve chamber, discharged from the discharge port, and discharged to the outside of the washing machine through the external drainage pipeline.

13. The washing machine according to claim 1, wherein, the second sewage outlet is normally open, the switch mechanism blocks the sewage inlet in the first working state, and the switch mechanism opens the sewage inlet in the second working state.

* * * * *